US005664532A

United States Patent [19]

August

[11] Patent Number: 5,664,532

[45] Date of Patent: Sep. 9, 1997

[54] UNIVERSAL FUEL PRIMING SYSTEM

[76] Inventor: Rex David August, 5086 Rd. O, Pandora, Ohio 45877

[21] Appl. No.: 621,831

[22] Filed: Mar. 22, 1996

[51] Int. Cl.[6] ..... F02M 59/42

[52] U.S. Cl. ..... 123/179.11

[58] Field of Search ..... 123/179.11, 179.17

[56] References Cited

U.S. PATENT DOCUMENTS

| | | | |
|---|---|---|---|
| 4,194,483 | 3/1980 | McChesney et al. | 123/179.9 |
| 4,373,479 | 2/1983 | Billingsley et al. | 123/179.11 |
| 4,542,723 | 9/1985 | Rujimoto | 123/179.9 |
| 4,660,516 | 4/1987 | Baltz et al. | 123/179.9 |
| 4,747,377 | 5/1988 | Schaller | 123/179.16 |
| 4,848,290 | 7/1989 | Miller | 123/179.13 |
| 4,862,847 | 9/1989 | Kobayashi et al. | 123/179.9 |
| 5,007,390 | 4/1991 | Tamaka et al. | 123/179.15 |
| 5,307,770 | 5/1994 | Davis et al. | 123/179.11 |
| 5,355,860 | 10/1994 | Ekstam | 123/516 |
| 5,372,115 | 12/1994 | Straub et al. | 123/510 |

*Primary Examiner*—Andrew M. Dolinar
*Attorney, Agent, or Firm*—Oldham & Oldham Co., L.P.A.

[57] ABSTRACT

A combined fuel supply and priming system for diesel engine is disclosed. The fuel supply portion of this system may be conventional and may include a fuel supply tank, a primary fuel filter, a fuel pump, a secondary fuel filter, and a plurality of injectors for injecting diesel fuel into combustion chambers of a diesel engine. A fuel line connects these parts so that diesel fuel flows through the parts in the order named. The fuel supply system may further include a return line leading from the injectors back to the fuel supply tank. The priming portion of the system includes a manually operated primer pump, which may be connected either in line with the other parts or via a bypass connection. When the primer pump is connected in line, it may be placed between the fuel pump and the secondary fuel filter. In line connection provides a single flow path for fuel used either for priming or for normal operation. Alternatively, the primer pump may be connected to the primary fuel line via a bypass, so that the primer fuel bypasses the fuel pump. In a bypass connection, the bypass line has an upstream leg extending from the primary fuel line upstream of fuel tank and a downstream leg extending from the primer pump to the primary fuel line downstream of the fuel pump. The primer pump is operated manually. This system in universally applicable to diesel engines.

5 Claims, 3 Drawing Sheets

FIG.-7
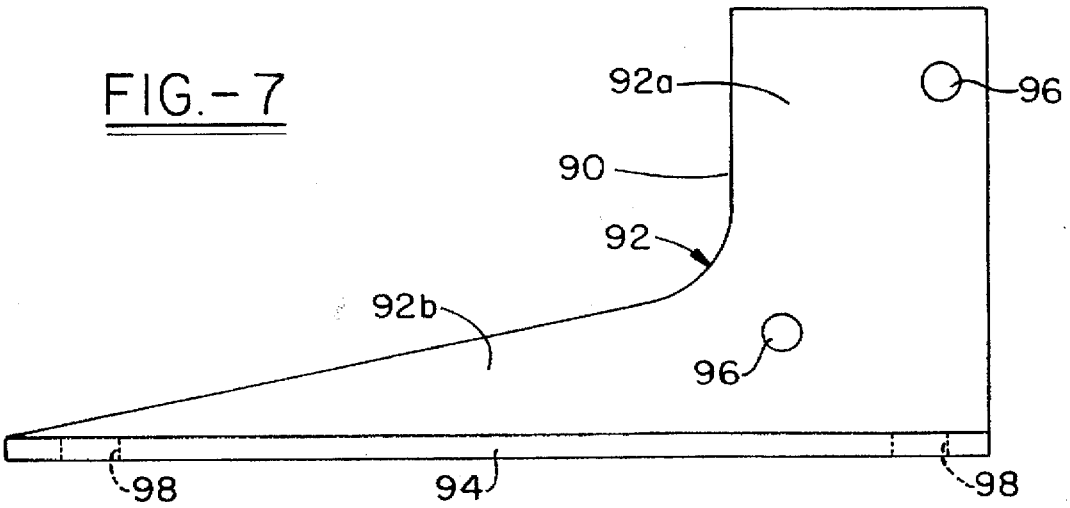
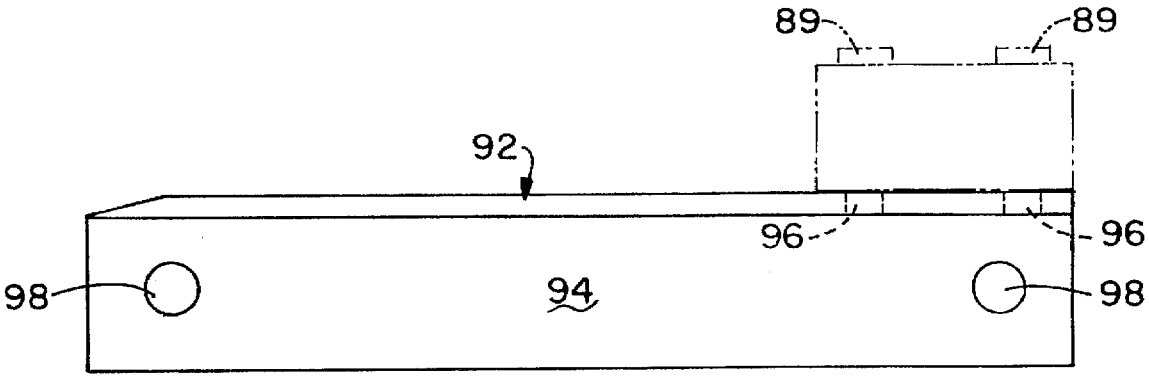
FIG.-8

UNIVERSAL FUEL PRIMING SYSTEM

TECHNICAL FIELD

This invention relates to a fuel supply and priming system for use on diesel engines.

BACKGROUND ART

Diesel engines are in widespread use, particularly as power plants for trucks, busses, tractors, and off-road equipment. One problem with diesel engines is that an engine is difficult to restart after an engine overhaul, a fuel system repair, a prolonged time when the vehicle is out of service, or other circumstances resulting in "drying up" or a loss of fuel by the engine. As a result, there are service calls along highways and at rest areas from truckers who are unable to restart the engine. Run down batteries are also frequent as a result of trying to restart an engine.

Priming systems for diesel engines are known. However, these are typically designed for operation with only one model of engine and will not work with other engines. Presently known priming systems also tend to be complex.

SUMMARY OF THE INVENTION

This invention provides a fuel supply and priming system for a diesel engine, the system comprising:

(a) a fuel pump having an inlet and an outlet;

(b) a manually operated primer pump having an inlet, and outlet, and a manual actuator for operating the pump;

(c) fuel conduit means for supplying liquid fuel from a fuel tank to one or more injectors for injecting liquid fuel into the engine, the fuel conduit means providing at least one flow path from the fuel tank to the injectors and including:

(1) a primary fuel line passing through the fuel pump and having an upstream portion extending from the fuel tank to the inlet of the fuel pump and a down stream portion extending from the outlet of the fuel pump to the injectors, and (2) means providing fluid communication from the priming pump to the fuel tank and to the injectors, the last-mentioned means including a connection from the outlet of the primer pump to the down stream portion of the primary fuel line, whereby all fuel passing through either the fuel pump or the primer pump flows in a single stream into the injectors.

BRIEF DESCRIPTION OF THE DRAWINGS

In the drawings:

FIG. 7 is a bottom view of a mounting bracket on which the pump mounting block is mounted.

FIG. 8 is a side view of the mounting bracket shown in FIG. 7, with the manifold block shown in broken lines.

DESCRIPTION OF THE PREFERRED EMBODIMENTS

Figure 1:
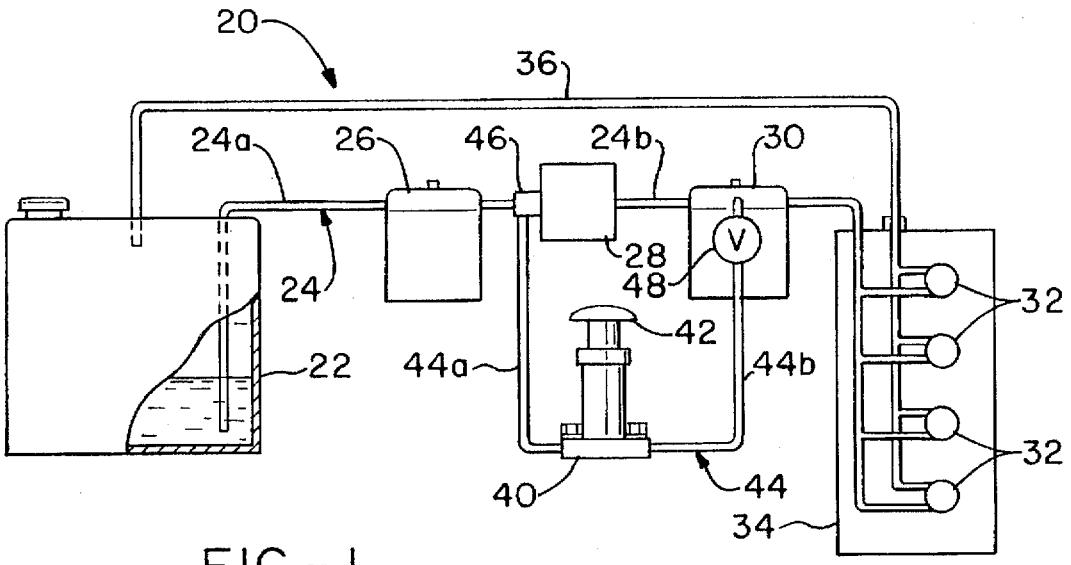
FIG. 1 is a schematic representation of a fuel pumping and priming system as a whole according to a first embodiment of this invention.

This invention will now be described in detail with reference to preferred embodiments thereof. Like reference numerals denote like parts.

Referring now to FIG. 1, 20 is a fuel supply and priming system for diesel engines in accordance with a first embodiment of this invention.

The novel priming system of this invention is universally applicable to diesel engines and their fuel supply systems. A standard fuel supply system for a standard diesel engine, such as that available from Detroit Diesel, Caterpillar, and others, is illustrated herein by way of example.

In FIG. 1, a standard fuel supply system, such as that available form Detroit Diesel, includes a fuel supply tank 22 which supplies diesel fuel through a primary fuel line 24 to a primary fuel filter 26, then to a fuel pump 28, then to a secondary fuel filter 30, then to fuel injectors 32 of a diesel engine 34, then (for unburned fuel) to a return line 36 back to the fuel supply tank 22. A fuel cooler (not shown) may be provided in return line 36. Primary fuel line 24 provides communication for liquid (i.e., diesel fuel) from tank 22 to fuel pump 28 and from fuel pump 28 to injectors 32.

A standard diesel engine has a plurality of cylinders, each of which provides a combustion chamber. Each cylinder typically has one injector for supplying diesel fuel in liquid form to the cylinder. This invention is applicable to a diesel engine regardless of whether the engine has one or more than one cylinder, and whether each cylinder has one or more than one injector. The plurality of injectors 32 for diesel engine 34 having plural cylinders constitutes a set of injectors, and this term will be used in this specification.

Fuel supply line 24 has an upstream portion **24*a* extending from fuel supply tank 22 to the inlet of fuel pump 28, and a downstream or pressure portion 24*b* extending form the outlet of fuel pump 28 to the injectors 32 of diesel engine 34**.

The novel fuel priming system of this invention is also illustrated in FIG. 1. Referring once again to FIG. 1, the priming system includes a manually operated primer pump 40 having an inlet and an outlet, and a manual actuator 42, here shown as a plunger, therefor. Primer pump 40 is connected to fuel supply line 24 on opposite sides of fuel pump 28 via a bypass connection 44. Bypass connection 44 includes an upstream passageway **44*a* which extends from a T fitting 46 in the upstream portion 24*a* of fuel line 24 to the inlet of primer pump 40, and a downstream or pressurized fuel passageway 44*b* which extends from the outlet of primer pump 40 to the second fuel filter 30, where the primer fuel stream passing through primer pump 40 rejoins the main (or operating) fuel stream which passes through fuel pump 28. T fitting 46 may be placed adjacent to the inlet opening of fuel tank 28 and has a single liquid fuel inlet and two fuel outlets, one leading to the inlet of fuel pump 28 for the operating fuel stream, and the other connected to bypass passageway 44*a*** for a primer fuel stream.

A manually operated on-off valve 48 is provided in bypass connection 44, preferably in the downstream passageway 44*b* just ahead of the connection between this passageway and the downstream portion 24*b* of main fuel line 24.

Primer fuel passes through both the primary fuel filter 26 and the second fuel filter 30, so that both of these filter primer fuel as well as operating fuel. Primer fuel bypasses fuel pump 28.

The upstream bypass passageway 44*a* may extend from a source of fuel upstream of fuel pump 28 to the inlet of primer pump 40. This source of fuel may be either the fuel tank 22 or anywhere in the upstream portion 24*a* of primary fuel line 24, the latter being preferred. Either arrangement provides fluid communication from the fuel tank 22 to the priming pump 40. FIG. 1 illustrates a particularly preferred embodiment wherein primer fuel passes through primary fuel filter 26 before the primer fuel (or bypass) stream and the main fuel stream diverge.

The system of FIG. 1 provides two flow paths for fuel from fuel tank 22 to injectors 32—one for operating fuel via fuel pump 28, the other for priming fuel via pump 40. Portions of the two flow paths (e.g., from tank 22 to primary filter 24, and from secondary filter 30 to injectors 32) coincide.

A standard fuel supply system as described above, and a novel priming system as described above together provide the novel fuel supply and priming system 20 according to one embodiment of this invention.

It is not necessary to modify a standard diesel engine, such as engine 34, in order to provide the novel fuel supply and priming system 20 of this invention. This is one of the major advantages of this invention. To achieve this, the same set of injectors 32 must be used for both primer fuel and operating fuel. To this end, the downstream bypass passageway 44*b* extends from the outlet of primer pump 40 to some point in the downstream portion 24*b* of the primary fuel line, e.g., at the secondary fuel filter 30 as shown, upstream of the injectors 32 of engine 34. All fuel passing through either the fuel pump 28 or the priming pump 40 flows in a single stream into the injectors 32.

The first embodiment of this invention, shown in FIG. 1, is particularly useful when the fuel pump 28 is a gear pump or other type of pump that will not allow liquid fuel to pass when the pump is idle.

A second embodiment of this invention will now be described with reference to FIG. 2. This embodiment also combines a standard fuel supply system with a novel priming system to provide a novel fuel supply and priming system 50 for diesel engines. This embodiment also requires no modification of a standard diesel engine 34.

A standard fuel supply system for this embodiment of the invention may be as shown in FIG. 1, and may comprise a fuel supply tank 22, a primary fuel line 24, a primary fuel filter 26, a fuel pump 28*a* having an inlet and an outlet, a secondary fuel filter 30, and fuel injectors 32 of a diesel engine 34, and a fuel return line 36. Primary fuel line 24 has an upstream portion 24*a* extending from fuel supply tank 22 to the inlet of fuel pump 28 and a downstream portion 24*b* extending from the outlet of fuel pump 28*a* to the injectors 32 of diesel engine 34.

Figure 2:
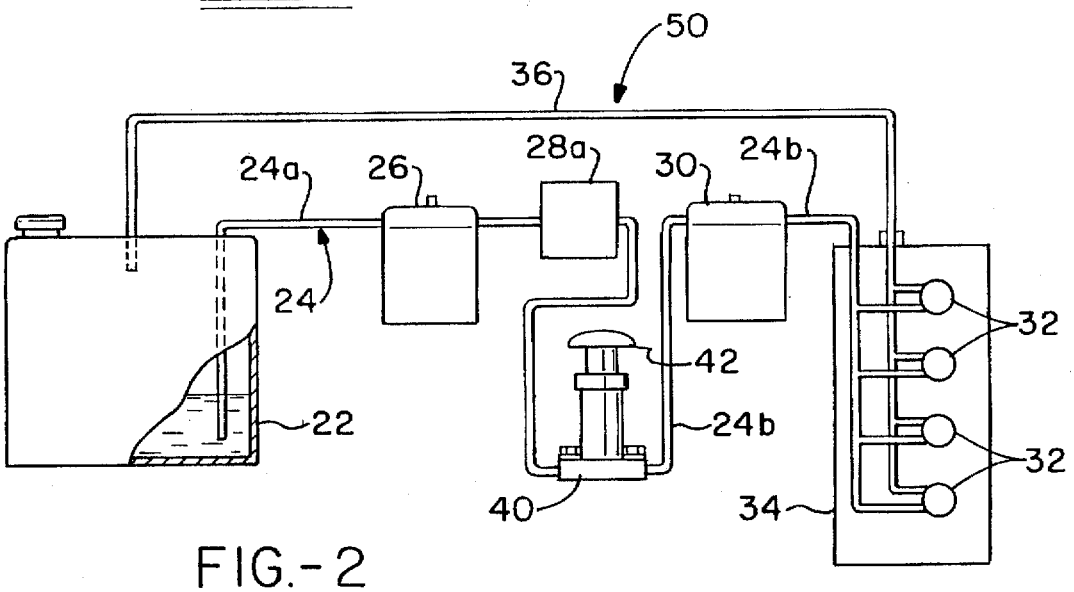
FIG. 2 is a schematic representation of a fuel pump and priming system as a whole according to a second embodiment of this invention.

Flow of diesel fuel in liquid form through the system shown in FIG. 2 is similar to that shown in FIG. 1.

The system 50 of FIG. 2 further includes a manually operable primer pump 40, which has an inlet, an outlet, and a manual actuator 42. Primer pump 40 of this embodiment may be like the primer pump 40 shown in FIG. 1. In this embodiment, primer pump 40 is connected in line, and to this end both the primer pump inlet and the primer pump outlet are connected directly to primary fuel line 24. Primer pump 40 is preferably connected in the downstream portion 24*a* of line 24. A preferred point of connection is between the outlet of fuel pump 28 and the secondary fuel filter 30, as shown in FIG. 2. This places all components of the system 50 in line and provide a single flow path for diesel fuel from fuel supply tank 22 to the injectors 32 of diesel engine 34, through primary fuel filter 26, fuel pump 28*a*, primer pump 40, and secondary fuel filter 30 in the order named.

A fuel supply and priming system 50 according to the embodiment of FIG. 2 is particularly useful when the fuel pump 28*a* is a diaphragm pump or other liquid fuel pump of such nature as to permit liquid fuel to pass through when the pump is idle.

The upstream fuel filter 26 and/or the downstream fuel filter 30 may be omitted in either embodiment of this invention, but both of these fuel filters are present in a standard fuel supply system for a diesel engine and their presence in the fuel supply and priming system of either embodiment of this invention is highly desirable.

Figure 3:
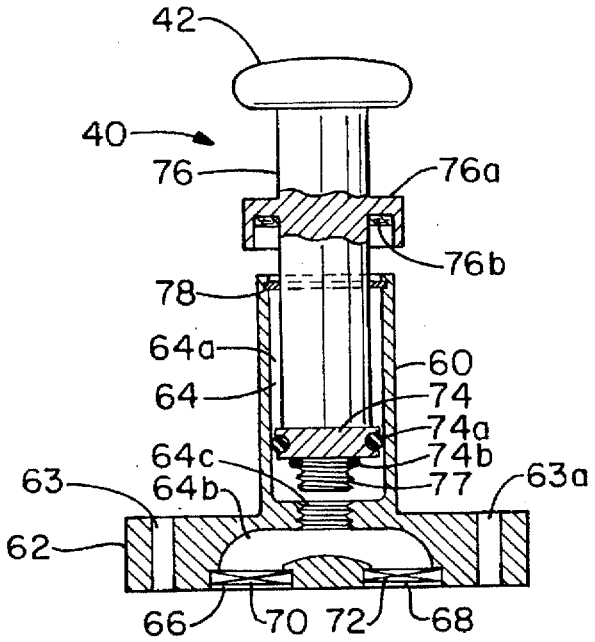
FIG. 3 is a vertical sectional view of a primer pump used in this invention.

Primer pump 40 is shown in greater detail in FIG. 3.

Primer pump 40 is may be a plunger-operated pump of conventional structure. Referring to FIG. 3, primer pump 40 comprises an upright, hollow cylindrical body 60 and a thin, flat horizontal base 62 which is integrally joined to the bottom of cylindrical body 60 and supports the body. Base 62 is a generally thombus-shaped attaching flange having a length which exceeds its width and also exceeds the diameter of cylindrical body 60. A pair of holes 63, 63*a* extend through base 62 near the ends thereof for attaching the primer pump 40 to a support member as will be hereinafter described. Inside primer pump 40 is a fluid chamber 64 through which priming fuel flows. Fluid chamber 64 comprises a cylindrical upper portion 64*a*, which is defined and enclosed by cylindrical body 60; a lower portion 64*b* in base 62, and a screw-threaded neck 64*c* which connects the upper portion 64*a* and the lower portion 64*b* of chamber 64. Primer pump 40 has an inlet 66 and an outlet 68, both of which are passageways communicating with chamber 64 and adapted to be connected with external conduits for diesel oil. Connections to external conduits may be as shown either in FIG. 1 or FIG. 2. Inlet 66 and outlet 68 may be vertical passageways extending from chamber 64 to openings in the bottom of base 62. One-way valves 70 and 72 may be provided in the inlet and outlet passageways 66 and 68, respectively, to prevent fluid flow in the reverse direction. One-way valves 70 and 72 may be diaphragm valves, so arranged so that one of these valves is open, and the other is closed, at all times. That is, when inlet valve 70 is open, outlet valve 72 will be closed, and vice versa. These one-way valves may be omitted in the system of FIG. 2, and in the system of FIG. 1 when valve 40 is present.

Primer pump 40 further includes a piston 74 which reciprocates in chamber 62. One end (a first end) of a vertical piston rod 76 is attached to piston 74. The other (or second) end of piston rod 76 is attached to manual actuator 42, which may be in the form of a plunger and is outside the body 60 of primer pump 40.

Piston 74 has a first seal 74*a* which may be an O-ring of resilient material in the piston head, and a second seal 74*b* of resilient material just below the piston head, to maintain sealing engagement between the piston 74 and the inside surface of the wall of body 60. Seals 74*a* and 74*b* are both ring-shaped or annular.

Piston rod 76 has a collar 76*a* which is above body 60, and a ting-shaped felt seal 76*b* under collar 76*a*. Seal 76*b* engages the top edge of body 60 in sealing engagement when piston 74 and plunger 42 are in their lowermost position. It will be noted that piston 74, piston rod 76, and plunger 42 together form a plunger assembly which reciprocates vertically as a unit.

A cylindrical screw-threaded boss 77 extends downwardly from the lower surface of piston 74. The external screw threads of boss 77 are received by the internal screw threads of boss chamber neck 64*c* when the plunger assembly is in its lowermost position. This makes a tight shut off of primer valve 40 possible when the primer valve is not in use.

A retaining ring 78 at the upper end of cylindrical body 60 retains piston 74 in place inside body 60 and limits the upward travel of piston 74.

Figure 4:
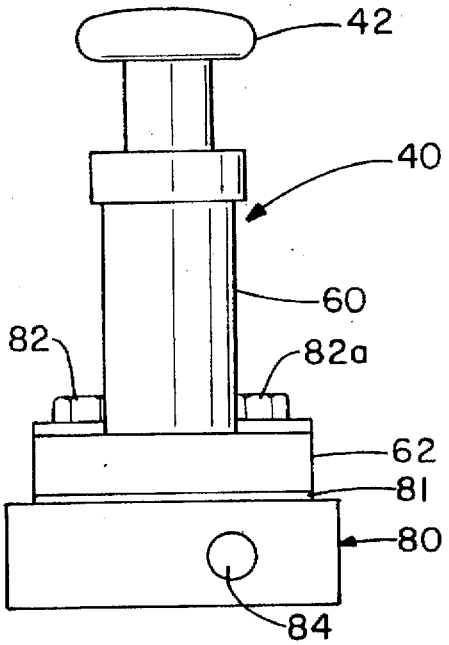
FIG. 4 is a front elevational view of subassembly comprising a primer pump and a manifold block (or pump mounting block) on which the primer pump is mounted.

Primer pump 40 (more specifically, base 62 thereof) is supported on a manifold block or pump-mounting block 80, as shown in FIG. 4. A gasket 81, which may be of resilient (e.g., robber or other elastomeric) material is interposed between the mounting block 80 and the base 62 of primer pump 40 to prevent leakage. Mounting block 80 is a rectangular prism which includes a flat, horizontal top face (the mating surface with the base 62 of primer pump 40) as will be described in more detail with reference to FIGS. 5 and 6. Similarly, the bottom surface of base 62 of primer pump 40 is flat. Primer pump 40 is affixed to manifold block 80 by means of screw-threaded bolts 82, 82*a* which extend through holes 63, 63*a*, respectively, (see FIG. 3) in the primer pump base 62 and through most of the thickness of the manifold mounting block 80. The primer pump base 62 may be of the same size and shape as the mounting block 80, or may be smaller, but no portion of the primer pump base 62 should extend beyond any edge of the mounting block 80. Primer pump base or attaching flange 62 is preferably in the shape of a rhombus having rounded corners. For the sake of this specification, a thombus is defined as a quadrilateral having four sides of equal length with two opposite acute angles and two opposite obtuse angles. The base 62 thus has a longitudinal axis which extends between the two acute angles. The preferred base 62 is preferably slightly smaller in its lengthwise direction and appreciably smaller in its transverse direction than the top surface of pump mounting block 80. A trace of base or flange 62, showing its size, shape, and position on pump mounting block 80 and the primer pump 40 mounted thereon, is shown by the dotted line in FIG. 5.

Figure 5:
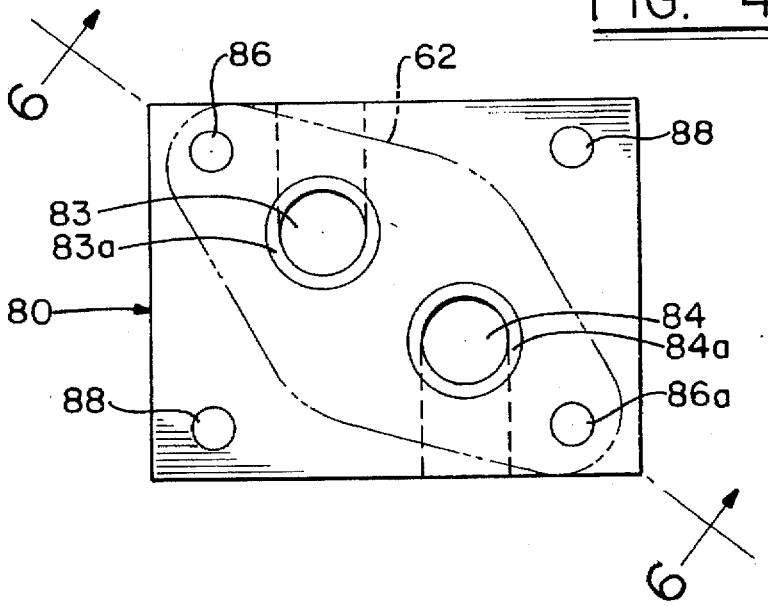
FIG. 5 is a top plan view of the pump mounting block shown in FIG. 4, with the location of a primer pump mounted thereon shown in dotted lines.
Figure 6:
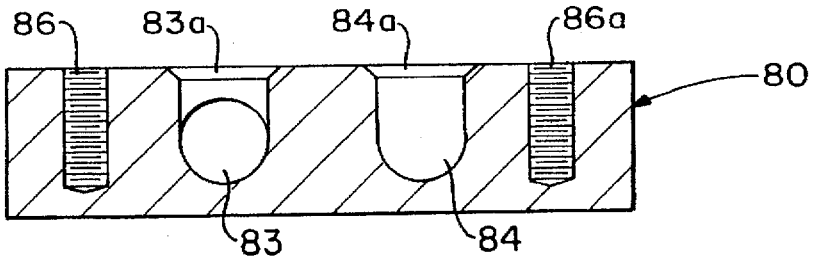
FIG. 6 is vertical sectional view of a pump mounting block according to this invention, taken along line 6—6 of FIG. 5.

Manifold block (or pump mounting block) 80 will now be described in detail with reference to FIGS. 5 and 6. Referring to FIGS. 5 and 6, manifold block 80 is a rectangular prism (as previously noted) having a horizontal rectangular top face, a horizontal rectangular bottom face which is spaced from the top face, and four vertical sides, namely a first pair of opposite parallel sides which extend longitudinally, and a second pair of opposite parallel sides which extend transversely. All sides are rectangular in shape. The mounting block 80 may or may not be square, and accordingly the second pair of sides (or ends) may be either of the same length, or shorter than, the first pair of opposite sides.

Manifold block 80 has a fuel inlet port 83 and a fuel outlet port 84 extending therethrough. Both are screw threaded and L-shaped. The inlet and outlet ports extend from the top face of manifold block 80 to opposite sides of manifold block 80 (in each case to a longitudinally extending side). Fuel inlet port 83 communicates with the fuel inlet passageways 66 in primer pump 40 and correspondingly fuel outlet port 84 communicates with outlet passageway 68 in primer pump 40. Fuel inlet port 83 and fuel outlet port 84 may be provided with frusto-conical tapered entries (or surfaces) 83*a*, 84*a*, respectively, in the top face of manifold block 80.

In a preferred embodiment, as seen especially in FIGS. 5 and 6, the center axes of the vertical portions of ports 82 and 83 may be laterally offset, so that a horizontal line drawn between these axes coincides with the longitudinal axis of base 62 and is at an acute angle to the longitudinally extending sides of manifold block 80 instead of being parallel to these sides. This arrangement makes it possible to maximize the size of base 62 relative to the size of manifold block 80. Manifold block 80 further includes a pair of screw-threaded holes or bores 86, 86*a* for receiving bolts 82, 82*a*, respectively. Bolt holes 63, 63*a* in the base 62 of primer pump 40 are aligned with holes 86, 86*a*, respectively, in manifold block 80. These bolt holes 86, 86*a* are located near opposite corners of the pump mounting block 80, as may be seen in FIGS. 5 and 6. These holes extend downwardly from the top face of mounting block 80 but terminate short of the bottom face thereof. Bolt holes 86, 86*a*, like bolts 82, 82*a*, may be either of the same or of different diameters. In a preferred embodiment, the pump mounting hole 86 nearest fuel inlet 83 is of slightly larger diameter than the pump mounting hole 86*a* nearest outlet 84. Manifold block 80 also has a second pair of mounting holes 88, situated near the two remaining opposite corners of the manifold block and extending through the entire thickness thereof, for attaching the manifold block by means of bolts 89 (FIGS. 8 and 9) to a mounting bracket 90, as will be described with reference to FIGS. 7 through 9.

The manifold block 80, and all parts herein, may be of any convenient size. Representative dimensions of manifold block 80 (suitable for a diesel powered truck) may be as follows: length, 3 inches; width, 2 to 3 inches; thickness, 1 inch. The vertical portions of inlet port 83 and outlet port 84 may be 7/16 inch in diameter; the horizontal portions of these ports may be ¼ inch in diameter and include screw-threaded portions for connection to an external pipe. Pump mounting hole 86 may be 5/16 inch in diameter, and pump mounting hole 86*a* may be ¼ inch in diameter; both are screw threaded, as are bolts 82, 82*a*. Manifold block mounting holes 88 may be ¼ inch in diameter and may be screw threaded. These dimensions are merely representative of a preferred embodiment and may be varied (considerably if desired) without departing from the scope of this invention.

Figure 9:
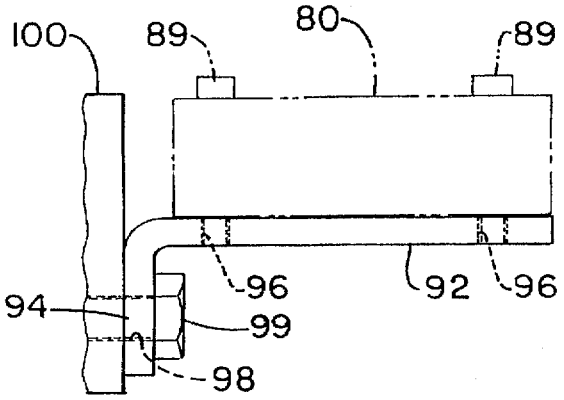
FIG. 9 is an end view of a subassembly comprising a manifold block (shown in broken lines), a mounting bracket, and a cylinder head (shown in fragmentary view) on which the mounting bracket is mounted.

A mounting bracket 90 for supporting manifold block 80 and a primer pump 40 mounted thereon is shown in FIGS. 7–9.

Referring now to FIGS. 7–9, mounting bracket 90 is of plate thickness (about ¼ inch) and comprises a horizontal member 92 and a downwardly extending vertical flange 94 which are integrally joined together along a longitudinally extending right-angle bend. This overall structure is best seen in FIG. 9.

The horizontal member 92 is generally L-shaped, as best seen in FIG. 7 (which is a bottom plan view looking up), and includes a transversely extending rectangular platform portion 92*a* for supporting manifold block 80, and a generally triangular and longitudinally extending brace portion 92*b* for added strength. These is no line of demarcation between portions 92*a* and 92*b*. The platform portion 92*a* is preferably of the same size and shape as the top and bottom faces of manifold block 80. A pair of mounting holes 96 at opposite corners of platform portion 92*a* are provided for receiving mounting bolts 89 for affixing manifold block 80 to mounting bracket 90.

Flange 94 is rectangular in shape as best seen in FIG. 8. Bolt holes 98 are provided near the ends of flange 94 for receiving mounting bolts 99 (FIG. 9) for affixing mounting bracket 90 to a stationary vehicle member, such as cylinder head 100.

Operation of fuel supply and priming systems will now be described.

During normal vehicle operation, when priming is not required, liquid diesel fuel under pressure flows from fuel supply tank 22 through primary fuel filter 26, fuel pump 28 (FIG. 1) or 28*a* (FIG. 2), then through secondary fuel filter 30 to the injectors 32 of a diesel engine 34 in either embodiment (i.e., either FIG. 1 or FIG. 2). Metered quantities of fuel are injected through injectors 32 into cylinders of engine 34 under pressure. Normally the quantity of fuel pumped through he system exceeds that actually injected into the engine cylinders, and the excess is returned back to fuel supply tank 22 through return line 36. Diesel fuel in this return line may be cooled by means of a cooler (not shown) if desired.

Now suppose that the system of FIG. 1 will not start and is in need of priming. On/off valve 48, which is shut during normal operation, is opened. Engine 34 is primed by manually pumping primer pump 40, using manual actuator 42. Priming fuel flows from a T-junction 46 in the upstream portion 24*a* of primary fuel line 24, via the upstream leg 44*a* of fuel bypass line 44, then through primer pump 40, thence through the downstream leg 44*b* of bypass line 44. Primer fuel returns to the primary fuel line 24 and specifically to the downstream portion 24*b* thereof, at secondary fuel filter 30. Primer fuel is routed through this secondary fuel filter. Primer fuel then continues via line 24*b* to the injectors 32 of engine 34, and is introduced into the engine.

Once the engine is started, pumping of primer pump 40 is discontinued, and on/off valve 48 is closed.

It will noted that primer fuel in this embodiment bypasses fuel pump 28.

Turning now to FIG. 2, when engine 34 in the system shown in FIG. 2 is in need of priming, one manually pumps fuel through the entire system from fuel tank 22 to injectors 32 via primer pump 40, by using the manual actuator 42. It will be noted that there is only one flow path in this embodiment, and all fuel, whether for priming or for normal operation, flows through the same flow path. Pumping of primer pump 40 is discontinued when the engine starts.

A system according to this invention (either FIG. 1 or FIG. 2) can be provided as initial equipment in a diesel-powered vehicle, or it can be installed later, say after engine overhaul. The system is easy to install and can be installed locally. It does not require installation at the factory or by a factory-trained technician. A system according to this invention enables one to quickly, easily, and cleanly to re-prime a stalled diesel engine in a truck, tractor, bus, or off-road equipment or any other vehicle having a diesel engine. A driver or vehicle operator can easily prime an engine which has a system according to this invention. This saves batteries, reduces down time, and virtually eliminates high-cost service calls.

Further advantages of a system according to this invention are simplicity and universality. A system (either system) according to this invention can be installed on any diesel-powered vehicle, in contrast to presently known priming systems which are specifically designed for use with a particular diesel engine.

While this invention has been described in detail with particular reference to preferred embodiments thereof, it shall be understood that this description is by way of illustration and not by way of limitation.

What is claimed is:

1. A fuel supply and priming system for a diesel engine, said system comprising:

(a) a fuel pump having an inlet and an outlet (b) a manually operated primer pump, having an inlet, and outlet and a manual actuator for operating said pump; and (c) fuel conduit means for supplying liquid fuel from a fuel tank to one or more injectors for injecting liquid fuel into said engine, said fuel conduit means providing at least one flow path from said fuel tank to said one or more injectors and including:

(1) a primary fuel line passing through said fuel pump and having an upstream portion extending from said fuel tank to the inlet of said fuel pump and a downstream portion extending from the outlet of said fuel pump to said one or more injectors, and (2) means providing fluid communication from said primer pump to said fuel tank and to said one or more injectors, the last mentioned means including a connection from the outlet of said primer pump to the downstream portion of said primary fuel line, whereby all fuel passing through either said fuel pump or said primer pump flows in a single stream into said one or more injectors;

wherein said primer pump is connected via a bypass to a source of fuel upstream of said fuel pump and to said downstream portion of said primary fuel line, whereby fuel passing through said primer pump bypasses said fuel pump, said bypass including an upstream passageway extending from said source of fuel upstream of said fuel pump to said inlet of said primer pump, and a downstream passageway extending from the outlet of said primer pump to said downstream portion of said primary fuel line.

2. A fuel supply and priming system according to claim 1 including a manually operated on/off valve in said bypass.

3. A fuel supply and priming system according to claim 1 in which said source of fuel upstream of said fuel pump is said upstream portion of said primary fuel line.

4. A fuel supply and priming system according to claim 3, said system further including a primary fuel filter in said upstream portion of said primary fuel line and a secondary fuel filter in said downstream portion of said primary fuel line.

5. A fuel supply and priming system according to claim 4 in which said bypass is connected to the upstream portion of said primary fuel line adjacent to said fuel pump and to the downstream portion of said primary fuel line at said secondary fuel filter.

* * * * *